US009997020B2

(12) United States Patent
Korthouwer

(10) Patent No.: US 9,997,020 B2
(45) Date of Patent: Jun. 12, 2018

(54) LOCAL JACKPOT SYSTEM APPEARING GLOBAL IN NATURE AND GLOBAL PRIZE MANAGEMENT SYSTEM AND METHOD OF USE

(71) Applicant: Hit Utopia, Inc., Willemstad (NL)

(72) Inventor: Dennis Korthouwer, Vienna (AT)

(73) Assignee: MYFUGUI BV (NL)

( * ) Notice: Subject to any disclaimer, the term of this patent is extended or adjusted under 35 U.S.C. 154(b) by 550 days.

(21) Appl. No.: 14/507,387

(22) Filed: Oct. 6, 2014

(65) Prior Publication Data

US 2015/0099577 A1 Apr. 9, 2015

Related U.S. Application Data

(60) Provisional application No. 61/886,821, filed on Oct. 4, 2013.

(51) Int. Cl.
*A63F 9/00* (2006.01)
*G07F 17/32* (2006.01)

(52) U.S. Cl.
CPC ..... *G07F 17/3258* (2013.01); *G07F 17/3225* (2013.01)

(58) Field of Classification Search
None
See application file for complete search history.

(56) References Cited

U.S. PATENT DOCUMENTS

2005/0239542 A1* 10/2005 Olsen ..... G07F 17/32 463/27
2006/0025221 A1* 2/2006 Jain ..... G07F 17/32 463/42
2013/0217473 A1* 8/2013 Oakes ..... G07F 17/329 463/25

* cited by examiner

*Primary Examiner* — Seng H Lim
(74) *Attorney, Agent, or Firm* — FisherBroyles, LLP; Rob L. Phillips

(57) ABSTRACT

A local jackpot system for land-based and online casinos. The jackpots comprise a continuous pool of 'Experiences You Can't Buy' prizes. Examples include: (a) a trip on a private jet with the soccer team of FC Barcelona, (b) a trip on a private yacht with one or more Formula 1 drivers during the Grand Prix of Monaco, (c) a shopping trip with Paris Hilton, (d) a dinner with George Clooney or (e) an acting scene in the next Hollywood blockbuster. The local jackpot system is configured to appear global in nature. Each client may be managed separately and can be customized via an internet connection. A monitoring application/module/system is installed with the purpose of monitoring and setting up local clients and broadcasting winning events globally. One or more random number generators ("RNGs") run on each client such that prize selection is accomplished randomly at each client.

36 Claims, 7 Drawing Sheets

400

LOCAL JACKPOT SYSTEM APPEARING GLOBAL IN NATURE AND GLOBAL PRIZE MANAGEMENT SYSTEM AND METHOD OF USE

CROSS REFERENCE

This application claims priority to U.S. Patent Application No. 61/886,821 filed Oct. 14, 2013.

FIELD OF THE INVENTION

The embodiments of the present invention relate to a local jackpot system providing unique prizes and cash prizes while appearing as a global jackpot system.

BACKGROUND

Casinos throughout the world compete for new players and strive to retain existing players. One way to attract new players is to offer the newest games, highest jackpots, best service, free play, exciting prizes (e.g., cars), etc. Of course, none of these methods of attracting new players is full proof as competitors can always offer something better and bigger.

Finding a solution to the problem of successfully, profitably and continuously attracting new players to casinos involves splitting the target market into two sections. First, there are traditional people who have already been in a casino and who are mostly focused on money ("money-focused people"). Second, there are people (the majority of the population) who have never been in a casino and who cannot be attracted by money ("new visitors").

It would be advantageous to develop a system attractive to both money-focused people and new visitors. Such a system should benefit players who frequent both brick and mortar casinos and online casinos.

SUMMARY

Casino suppliers and/or casino product developers have created many similar products which essentially target money-focused people. Examples of such products include 'bonus' jackpot systems, side-bet games and progressive jackpot systems developed by DEQ Corp, SHFL Entertainment, Inc., IGT, TCS John Huxley and others. The inherent drawback with such products is they offer cash only and as such target only a very small percentage of the population, namely people who are already coming to casinos. Another drawback is that such products are not rolled out internationally because of restrictive international (tax) laws. By way of example, it is not possible to launch a progressive jackpot (from legal and tax perspective) between a large tax and highly regulated country like the United States and a low tax and lightly-regulated market like Macedonia, Cyprus or St. Marten. On top of this, most products are sold, leased or rented to individual casinos resulting in limited prize sizes.

Accordingly, the embodiments of the present invention involve a local jackpot system installed and accessible via land-based and online casinos. The jackpots comprise a continuous pool of 'Experiences You Can't Buy' tailored to specific micro-target groups while continuously targeting new micro-target groups with new 'Experiences You Can't Buy' with the objective of attracting new visitors and customers. 'Experiences You Can't Buy' are prizes which are normally not available to the public, including the wealthiest people on earth. Example experiences include: (a) a trip on a private jet with the soccer team of FC Barcelona, (b) a trip on a private yacht with one or more Formula 1 drivers during the Grand Prix of Monaco, (c) a shopping trip with Paris Hilton, (d) a dinner with George Clooney, (e) an acting scene in the next Hollywood blockbuster or (f) an acting scene in your favorite soap opera. The embodiments of the present invention also offer prizes to attract money-focused players as well.

In one embodiment, the embodiments of the present invention are configured as a local jackpot system which appears global in nature (but is not). The local jackpot system comprises many clients with customized prize offerings where the winning events only are broadcast globally giving players the impression that the local jackpot system is global in nature. In one embodiment, each individual client is managed separately and can be customized via an internet connection. None of the clients need to be the same as any others; not from a layout perspective and not from a prize offering perspective. A monitoring application/module/system is installed with the purpose of monitoring and setting up local clients and broadcasting winning events globally. In one embodiment, a random number generator ("RNG") runs on each client such that the winner selection is accomplished randomly on each client. There is no pooling of funds by participating casinos for the payout of prizes which are fixed. In one embodiment, the local jackpot system detailed herein comprises five (5) prize tiers where each tier and corresponding prizes can be turned on or off by the subject casino.

Other variations, embodiments and features of the present invention will become evident from the following detailed description, drawings and claims.

DETAILED DESCRIPTION

Figure 1:
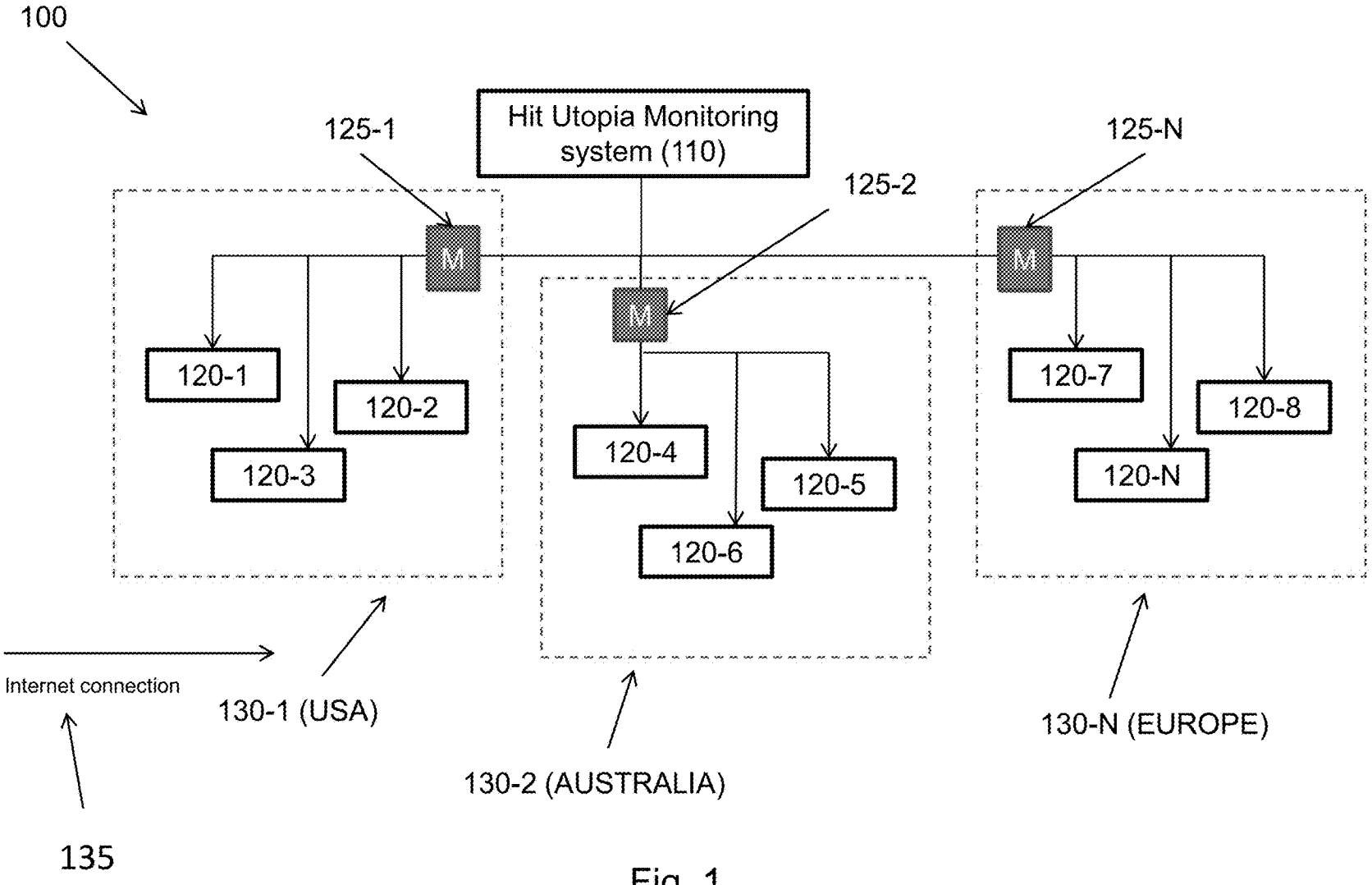
FIG. 1 illustrates a block diagram of local jackpot system according to the embodiments of the present invention.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to one skilled in the relevant art and having possession of this disclosure, are to be considered within the scope of the invention claimed.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.), or an embodiment combining software and hardware. Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), and optical storage device, a magnetic storage device, or any suitable combination of the foregoing. In the context of this document, a computer readable storage medium may be any tangible medium that can contain or store a program for use by or in connection with an instruction execution system, apparatus, or device.

A computer readable signal medium may include a propagated data signal with computer readable program code embodied thereon, for example, in baseband or as part of a carrier wave. Such a propagated signal may take any variety of forms, including, but not limited to, electromagnetic, optical, or any suitable combination thereof. A computer readable signal medium may be any computer readable medium that is not a computer readable storage medium and that can communicate, propagate, or transport a program for use by or in conjunction with an instruction execution system, apparatus, or device.

Program code embodied on a computer readable medium may be transmitted using any appropriate medium, including but not limited to wireless, wireline, optical fiber cable, RF and the like, or any suitable combination of the foregoing.

Computer program code for carrying out operations for aspects of the present invention may be written in any combination of one or more programming languages, including an object oriented programming language such as Java, Smalltalk, C++ or the like or conventional procedural programming languages, such as the "C" programming language, AJAX, PHP, HTML, XHTML, Ruby, CSS or similar programming languages. The programming code may be configured in an application, an operating system, as part of a system firmware, or any suitable combination thereof. The programming code may execute entirely on the user's computer, partly on the user's computer, as a standalone software package, partly on the user's computer and partly on a remote computer or entirely on a remote computer or server as in a client/server relationship sometimes known as cloud computing. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer-implemented process such that the instructions which execute on the computer or other programmable apparatus provide processes for implementing the functions/acts specified in the flowchart and/or block diagram block or blocks. As used herein, a "terminal" should be understood to be any one of a general purpose computer, as for example a personal computer or a laptop computer, a client computer configured for interaction with a server, a special purpose computer such as a server, or a smart phone, soft phone, tablet computer, personal digital assistant or any other machine adapted for executing programmable instructions in accordance with the description thereof set forth above.

The embodiments of the present invention involve making available in casinos and other gaming venues and non-gaming venues (e.g., supermarkets) (as both gambling and/or promotional solution) and via a proprietary online platform a variety of prizes which are so unique and desired by certain identified groups of people ('Experiences You Can't Buy") they attract such groups of people to the casinos and other gaming venues. While gaming venues are but one type of venue suitable for the embodiments of the present invention, for the sake of brevity, the detailed description herein focuses on gaming venues for the sake of brevity.

FIG. 1 shows a block diagram of a local jackpot system 100 according to the embodiments of the present invention. Broadly, the local jackpot system 100 includes a monitoring application/module/system 110 in communication with a series of clients 120-1 through 120-N installed in casino table games. Optional media servers 125-1 through 125-N may be integrated between the monitoring system 110 and clients 120-1 through 120-N. The series of clients 120-1 through 120-N may be installed on casino table games in any location and may be installed on slot machines, gaming terminals, etc. Each client 120-1 through 120-N may have unique graphics and look and feel to match the location. As shown, three locations 130-1 through 130-3 house the multiple clients 120-1 through 120-N. As shown, the locations are in Europe, Australia and United States. Those skilled in the art will recognize that any number of clients and locations are suitable for the embodiments of the present invention.

In one embodiment, the local jackpot system 100, in the form of software and hardware, is connected to an existing casino management system or similar system operated by the casino. Alternatively, the local jackpot system 100 may be a standalone system linked directly to the clients 120-1 through 120-N. Via an Internet connection 145, the clients 120-1 through 120-N may be customized (e.g., different prize tiers configured and turned on and off and layouts adapted to local market) to maximize the revenues per client. Moreover, different prize pools may be utilized for different markets. For example, U.S. players want different prizes than players in Tobago. Other examples include a larger casino utilizing a greater hit frequency than a small casino and a first casino utilizing softer colors than more vibrant colors to attract players. In one embodiment, a prize pool comprises a prize tiers. In one embodiment, as shown in Table 1 below, five prize tiers are available.

TABLE 1

| TIER | PRIZES |
|---|---|
| 1 | Quick Cash |
| 2 | Casino-Related Prizes |
| 3 | Bonus |
| 4 | Experiences You Can't Buy |
| 5 | Jackpot |

The quick cash prizes of tier 1 comprise small cash prizes (e.g., $1); casino-related prizes comprise prizes often arranged for free by the casino (e.g. dinner at the casino, stay at the hotel) or arranged by operator (e.g., third party) in the form of free prizes in exchange for advertising the prize on each of the clients globally; bonus prizes comprise larger cash prizes (e.g., monthly salary); 'Experiences You Can't Buy" prizes comprise unique prizes which money cannot buy (e.g., scene in a movie); and the jackpot prize comprises the largest cash prizes (e.g., $1M). Those skilled in the art will recognize that the prize structure, types and amounts may be different. Casinos are able to tailor the overall prize pool by turning on and off each offered prize and/or tier. Moreover, the casinos are able to do this selectively for each client 120-1 through 120-N.

Figure 2:
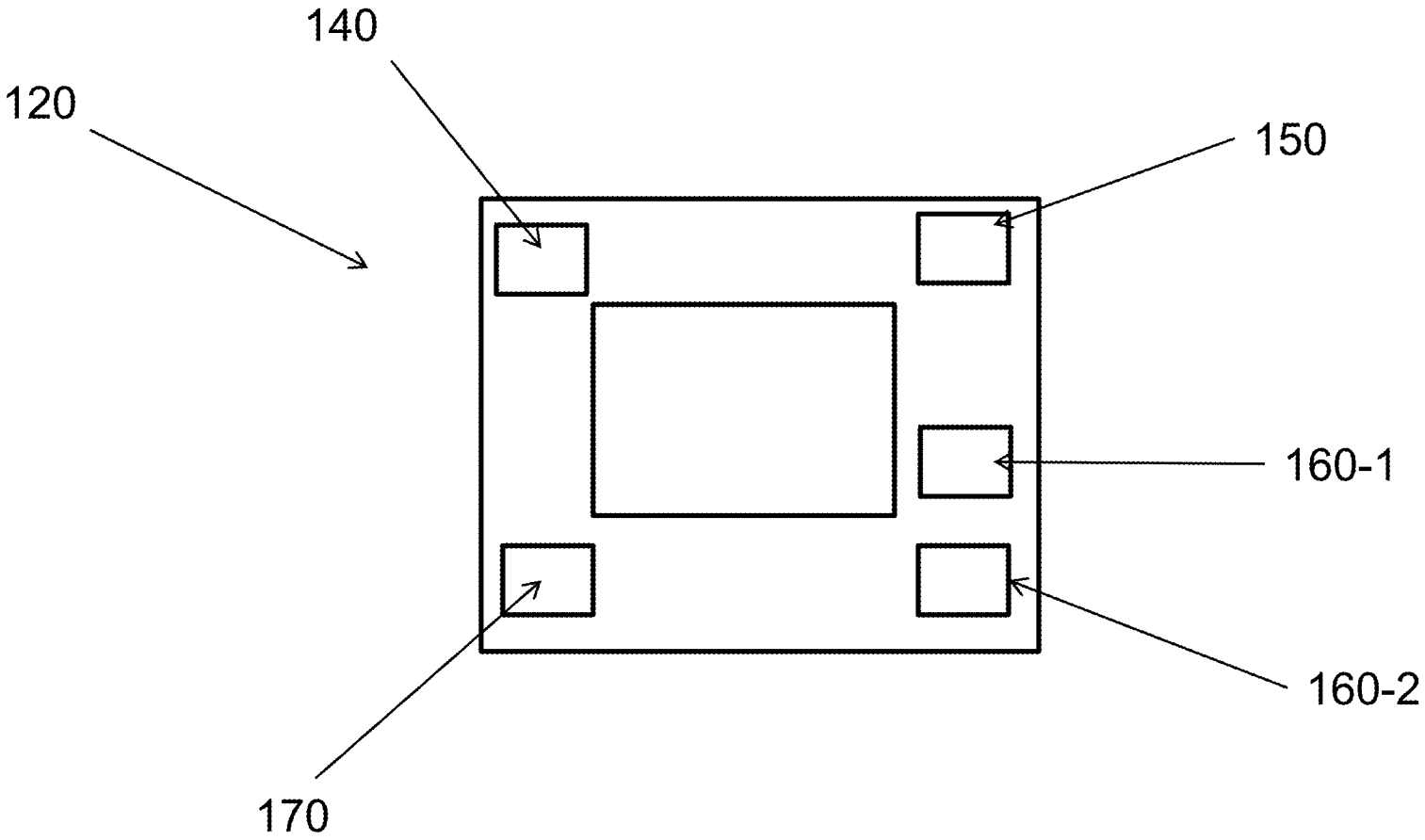
FIG. 2 illustrates a block diagram of a client according to the embodiments of the present invention.

Now referring to FIG. 2, each client 120-1 through 120-N installed on a casino table game, comprises a screen, computer processor, RNGs and a user interface device. For example, each casino table game client utilizes a table game computer having a screen, processor, RNGs and a user interface in the form of a keypad. The keypad user interface provides means for a dealer to activate the jackpot system prior to each play of the underlying game (e.g., blackjack, roulette, etc.).

With table game clients, players purchase credits to participate in the method of awarding jackpots as offered by the local jackpot system 100. In one embodiment, a dealer begins the underlying game (e.g., blackjack) and responsive to bets or wagers having been placed or paid for, activates local jackpot system 100 using the keypad user interface (or other interface). The local jackpot system 100 then connects to the monitoring system 110 and for tiers 4 and 5 requests the size of the prize pool and available prizes. Upon receiving the prize pool and available prizes information, the client begins the draw process to determine if (i) there is a winner at the table; (ii) the prize won; and (iii) and the player position at the table winning the prize. The player position may relate to a player not placing the required or appropriate bet to participate. The process repeats until a player position is identified with a player placing the appropriate bet. In one embodiment, tier 1 prizes (small cash prizes) are transferred directly to electronic or digital player accounts, tier 2 (casino prizes) are paid by the casino on property, tier 3 prizes are paid by the casino on property, and for tier 4 and tier 5 prizes a special voucher is provided to winner which entitles him or her to claim the prize directly from operator of the local jackpot system 100. The local jackpot system 100 makes available to each connected property each of the prize tiers for which there is no financial contribution by the casino. In one embodiment, at the end of the month, the local jackpot system 100 operator invoices the property for the amount wagered on the local jackpot system 100 minus any hold for the casino.

The local jackpot system 100 is configured to award prizes randomly to players playing any game, device or client within the system network. As set forth above, in one embodiment, on table games, players have to be playing the underlying game (e.g., Blackjack) in order to participate in the local jackpot system facilitated by the local jackpot system 100. However, results of the underlying game do not influence the outcome of the jackpots awarded by the local jackpot system 100. Activating the local jackpot system 100 is a function of the dealer (or other personnel) at live games and automatically via servers running software conducting electronic or online games. For example, at a live table, the dealer may be required to enter a key combination on the user interface (e.g., keypad) once the initial game hand is being dealt, roulette ball spun, etc.

In one embodiment, the local jackpot system 100 is marketed under the fanciful name "Hit Utopia."

Figure 4A:
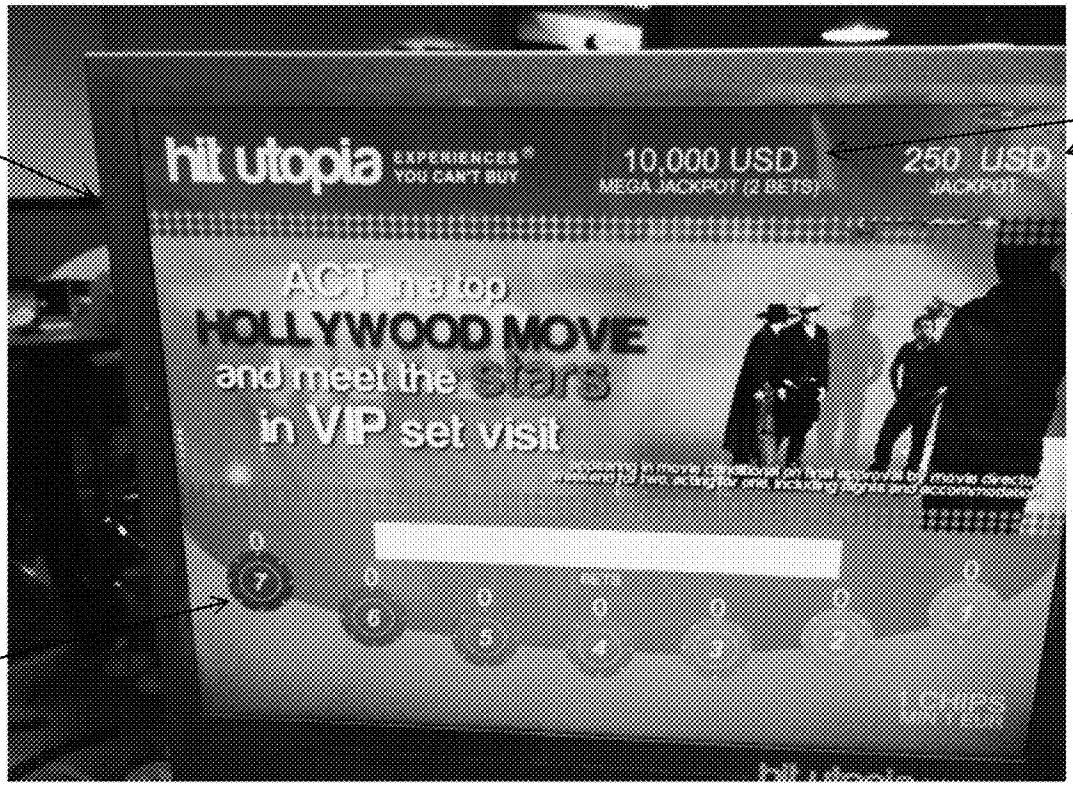
FIGS. 4A and 4B illustrate table game displays according to the embodiments of the present invention.
Figure 4B:
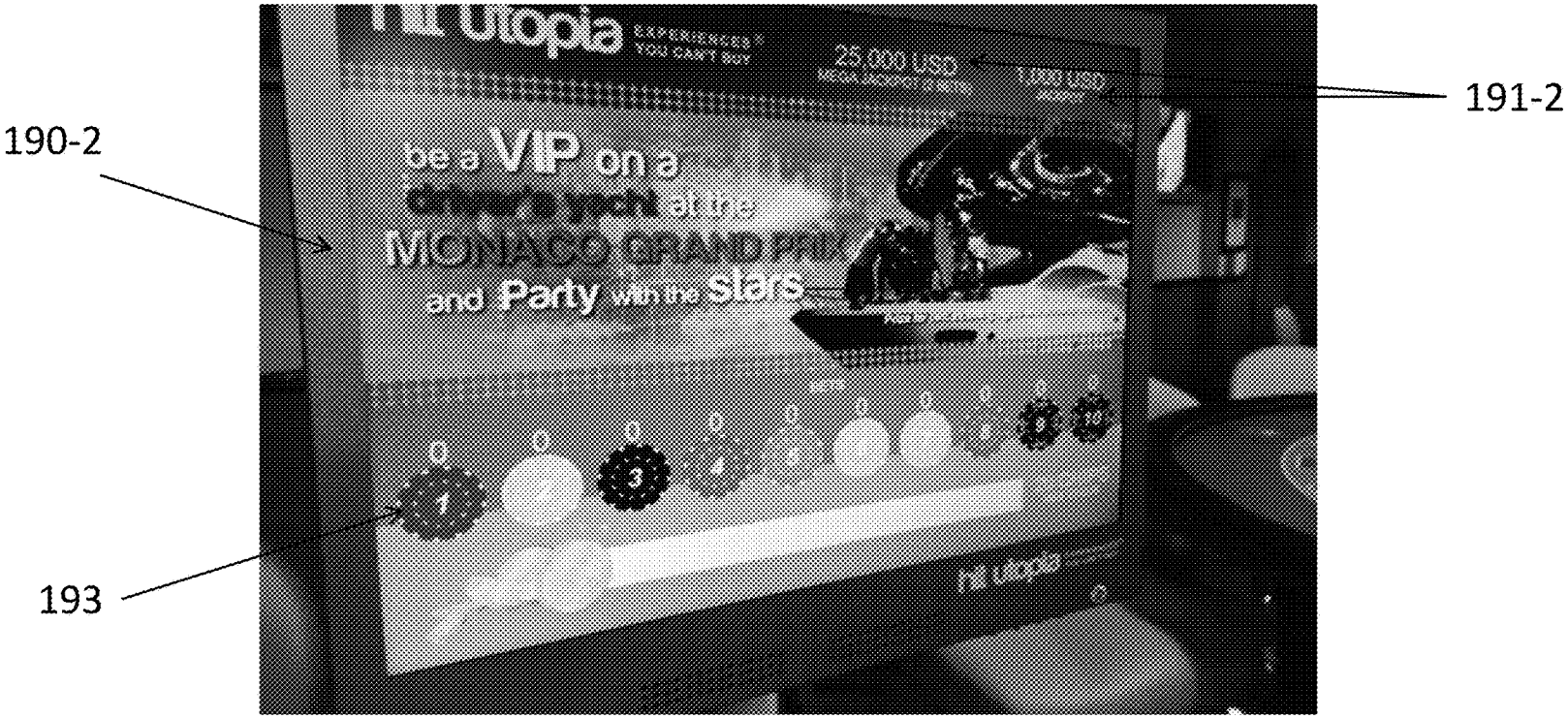

FIGS. 4A and 4B show exemplary displays 190-1 and 190-2 for live blackjack and roulette games, respectively. The displays 190-1, 190-2 face players and depict prizes 191-1, 191-2 and bets placed by player position 192 or chip color 193. The displays 190-1 and 190-2 are intended to convey information and encourage bets.

Figure 5:
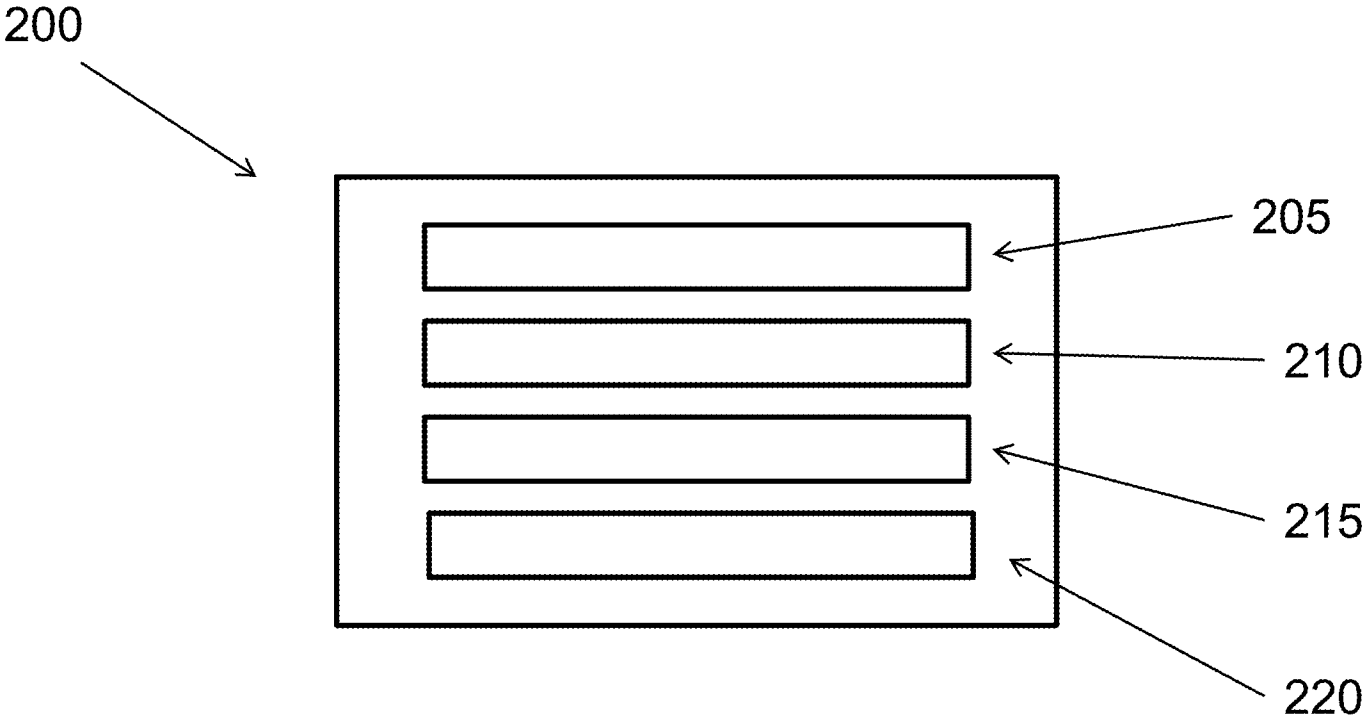
FIG. 5 illustrates a software program according to the embodiments of the present invention.

As shown in FIG. 5, the local jackpot system 100 may incorporate various software applications 200, including an equalizer module 205, multiplier module 210 and global winner notification module 215. The local jackpot system 100 provides a lock free environment. Each of the features facilitates the local jackpot system 100 and, as shown in FIG. 5, may be in the form of applications or modules as described below.

The equalizer module 205 facilitates offering different prizes with different values within a single prize tier. The equalizer module 205 creates the chance (i.e., prize value multiplied by chance) of winning any prize in the tier equal to any other prize in the tier. For example, if a prize pool in a certain tier has a $100,000 pool including a prize of $20,000 and another prize of $10,000, the equalizer module 205 for the $20,000 prize is 1 and the equalizer for the $10,000 prize is 2. Accordingly, if a player places a $1 side bet, the player will have two chances to win the $10,000 prize ($1 multiplied by equalizer of 2) while placing a $1 side bet, the player will have one chance to win the $20,000 prize ($1 multiplied by equalizer of 1).

In one embodiment, a bet pool is calculated as (i) value of the highest prize (US dollars) divided by (ii) (1 minus casino's hold percentage minus the hold percentage of the operator of the local jackpot system) multiplied by the multiplier (e.g., 10,000). The multiplier module 210 assists with overcoming currency and decimal issues. Without a multiplier module 210, if the bet pool was $1000 and a player wagered or bet $1, the calculation of a winner is simple—1:1000. However, if the bet pool remains $1000 and a player wagers 1 Euro, then the chance of winning is 1,323:1000 (based on 1,323 Euros per US dollar). Thus, the local jackpot system 100 would need to generate a number of 1323 from only 1000 options. This issue is overcome by multiplying the wager and pool with a large value (e.g., 10,000). So, using the previous example, you have a 13,230: 10,000,000 chance of winning.

With the multiplier module 210 and equalizer module 205 in place, a winner selection process may be undertaken as follows:

(i) Wagers in local currency of all players participating in the game on the local jackpot system 100 are combined, converted to a US dollar value ("Bet Budget") and then multiplied by the percentage contribution for each tier that is being played ("Total Level Bet Budget");

(ii) The Total Level Bet Budget is then multiplied by the Multiplier (the "Increased Total Level Bet Budget") resulting in a natural number;

(iii) The actual pool size (in US dollars) is multiplied by the Multiplier (the "Increased Pool Size");

(iv) The Increased Total Level Bet Budget is the total number of times that the local jackpot system 100 checks if there is a winning event for this 'single' game in this tier by following the next process: Two Random Number Generators ("RNGs") select a number from 1 to the higher end of the Increased Pool Size. In the event the two RNG's generate the identical number, a winning event ("Winning Event") is declared. A single random number generator or other random generation means may be used as well.

(v) Following the Winning Event, the local jackpot system 100 checks which player is the winner. In order to stimulate game play, the wagers of all players—whether or not they placed a wager on a game on the local jackpot system 100—are increased with the system game minimum ("Increased Wager") so that the Winning Event can take place at all player positions. Then, a random number is chosen between 1 and the Increased Wager and mapped to the respective player position. In the event the Winning Event takes place at player position that didn't place a Wager, a 'no-winner' message is shown. In such case a new winner ("New Winner") is selected by choosing a random number between 1 and the total Wagers and mapped to a player position.

Figure 3:
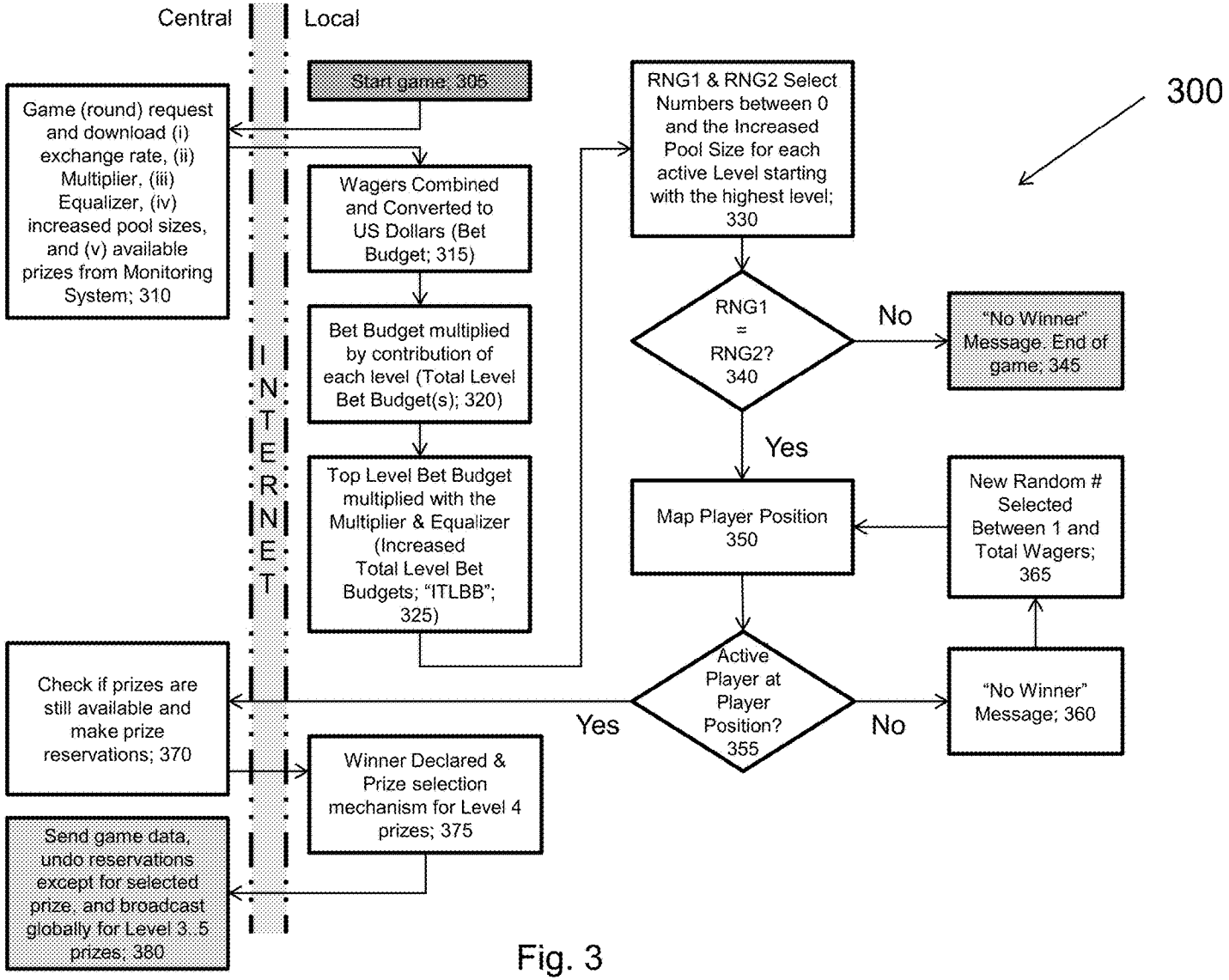
FIG. 3 illustrates a flow chart detailing a method of conducting a local jackpot system according to the embodiments of the present invention.

FIG. 3 shows a flow chart 300 detailing a methodology of utilizing the local jackpot system 100 as described above. At 305, an underlying game is started. At 310, via an Internet connection, game (round) request and download of (i) exchange rates, (ii) Multiplier data, (iii) Equalizer data, (iv) increased pool sizes, and (v) available prizes are transmitted or downloaded or otherwise made available to local clients 120-1 through 120-N from the monitoring system 100. At 315, wagers are combined and converted to US dollars to form a Bet Budget. In one embodiment, players may pre-pay for local jackpot bets in advance whereby the dealer activates the local jackpot system 100 prior to each game play. For example, a player may give the dealer $10 for 10 plays on the local jackpot system 100. At 315, the Bet Budget is multiplied by the percentage contribution for each tier that is being played to form a Total Level Bet Budget. At 320, the Total Level Bet Budget is multiplied by the Multiplier to form the Increased Total Level Bet Budget which is a natural number. At 325, the actual pool size is multiplied by the Multiplier to form the Increased Pool Size. At 330, two RNGs select a number from 1 to the higher end of the Increased Pool Size. At 340, it is determined if the two random numbers selected by the two RNGs are identical. If not, at 345, the local jackpot system 100 generates a "No Winner" message. If, at 340, it is determined that the two random numbers are identical, at 350, a player position is mapped. The player position may be any live table game location, gaming device or online position (i.e., collectively clients) forming part of the networked local jackpot system 100. At 355, it is determined if the mapped player position has a player playing and placing a bet. If not, at 360, the local jackpot system 100 generates a "No Winner" message. At 365, a new winner is selected by choosing a random number between 1 and the total Wagers and the chart 300 loops back to 350. Once a winner is selected at 365, at 370, prizes are checked for availability and reserved if available. At 375, a winner is declared and selection mechanism activated for tier 4 prizes. At 380, game data is sent, reservations undone except for selected prize and results broadcast globally (i.e., to all clients) for tier 3, 4 and 5 prizes. In other embodiments, less than all clients may receive winning updates or certain clients may receive desired information and notices.

The winning event process above includes numerous features which render the local jackpot system 100 unique over other jackpot processes. More specifically, the use of two RNGs, the ability to handle fractional figures and the winning event not being directly related to a certain player to (i) stimulate players to participate and (ii) make the game more exciting.

Prize notification across the platform allows a local jackpot system 100 to appear to be global in nature. Normally a central jackpot system selects winners in favor of saving time. With a wide area jackpot system, the time for declaring one winner from five linked tables with odds of 1:2000 is once in every 1000 games; or once in every 200 games (1000 divided by 5 tables). Such a structure is nearly impossible to install worldwide due to (tax) regulations and other logistical impediments. When installing five separate jackpot systems across five separate tables, it normally will take 1000 games before there is a winner. Consequently, in the first case (considering there are 200 games per day on a table) it takes one day for someone to win the jackpot and in the second case it takes up to five days for someone to win the jackpot (and then they will all hit at the same time). The embodiments of the present invention use a related structure except it differs by (a) reducing the prize pool when there is no winner of the prize (empty player position); and (b) when there is a winner it is broadcast to all non-winning screens so it appears to be a global, linked system.

Another problem with many global, wide-area jackpot systems is that they scale poorly due to latency and locking mechanisms normally in place. With a standard progressive jackpot system—where the prize can be won only once as it accrues—every time someone requests a draw from the progressive jackpot, a temporary lock is placed on the prize until it is determined whether or not that player won. In land-based casinos located in a single country with a limited number of gaming devices, such a local jackpot system may be manageable, but when spreading across the globe, including cruise ships where latency can be extremely high (e.g. seconds instead of milliseconds), such a local jackpot system is untenable. To overcome such concerns, the local jackpot system 100 detailed herein is an entirely lock-free, round-based prize management system configured to manage the games played concurrently on hundreds of thousands of systems globally. This local jackpot system 100 is scalable and inherently capable of dealing with high latencies. For example, if there is a winner in the 'Experiences You Can't Buy' prize pool (tier 4), for each of the prizes, the number of available units is temporarily reduced by 1 (i.e., these prizes are reserved) and a new (game) round with a respective game round number starts. In the new (game) round, the pool is reset (to its original or a new value) and only game requests and/or potential winners in this new game round number are accepted as valid requests. Then, the available prizes are communicated to the winning client where one prize is selected by the winner and for each of the prizes except the chosen prize the number of available units is increased again by 1. Such a system allows an unlimited number of clients to be connected.

As set forth above, prizes are fixed and as such can be instantly turned on and off. During each round players have a chance to win a prize while no money is pooled for the payout of prizes. As a result, the local jackpot system 100, through a management module 220, can update its prize offering 'on-the-fly' and adapt the prize offering to different locales and/or times of day. In one embodiment, the local jackpot system 100 is initially set up manually, but then automatically updates the prize offerings and/or value of the prizes based on the amount of play on the local jackpot system 100. For example, the local jackpot system 100 learns when to offer a dinner with George Clooney or when to offer a party in the Playboy Mansion (both have a different target audience and one target audience might be offended by the offer for the other group and as such the local jackpot system 100 leaves out the Party in the Playboy Mansion prize when the George Clooney target group is playing). The same is true for cash prizes. During the day, the tier 3 prize of $1000, for example, may be reduced to $500 as this prize better fits the target audience. In one embodiment, the automation and modification of prizes is accomplished via A-B testing and the local storing of game play and prize offering data as handled by the management module 220.

In one embodiment, a dealer enters the table, he/she fills in his/her personal (casino) ID. On a daily, weekly, monthly, or yearly basis, the local jackpot system 100—as a local or global dealer incentive scheme—may award a special prize (e.g. an 'Experience You Can't Buy') to the dealer with for example (i) the most system games per 30 minute increments; (ii) the highest total wagers on the local jackpot system 100 in any given 30 minute increment; and/or (iii) the highest drop on the local jackpot system 100 in a given time period. Those skilled in the art will recognize that the dealer award may be based on any criteria desired by the casino. Despite the criteria used, the dealer awards encourage the dealers to be committed to stimulate play on the local jackpot system 100 and can be implemented wherever legally allowed.

As described above, when installed in land-based casinos, a keypad 171 may act as a user interface. By requiring dealers to login to the local jackpot system 100 when dealing a game, the local jackpot system 100 is configured to track, store and analyze the timing and time (in milliseconds) of individual keystrokes and combinations thereof. With the results, the local jackpot system 100 is able to determine (i) whether or not the dealer has irregular behaviors and (ii) the chance that the dealer is corrupt (i.e. stealing from the casino). Such information is valuable to casinos.

The local jackpot system 100 can be installed at gaming tables in land-based and online casinos; slot machines and other electronic gaming devices in land-based and online casinos; standalone version in casinos, slot halls and bet shops; as game on ATMs or point of sale devices; and/or as additional feature or promotion on games of skill. In other words, while the local jackpot system 100 detailed herein focuses on gaming, it should be understood that the local jackpot system 100 may be installed in non-gaming networks or systems as well (e.g., lotteries, points of sale (e.g., supermarket check outs) and other non-gaming venues).

Figure 6:
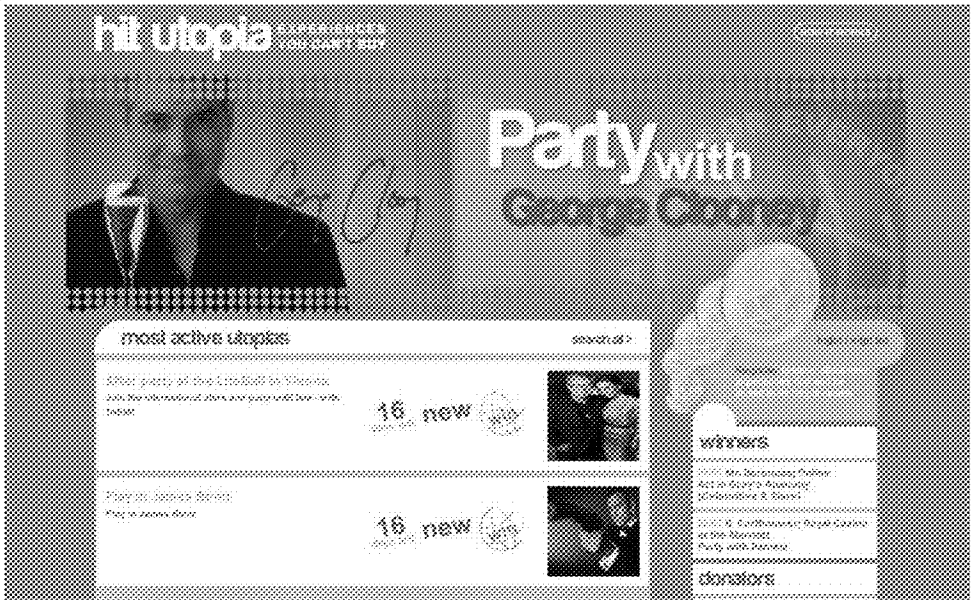
FIG. 6 illustrates a screen shot of an exemplary promotional website according to the embodiments of the present invention.

The local jackpot system 100 may incorporate a charity sourcing platform which allows charities from all over the world to easily raise funds for their charities with the help of their ambassadors (who in cases may form the 'Experiences You Can't Buy'). In one embodiment, the local jackpot system 100 focuses on arranging the 'Experiences You Can't Buy' in cooperation with charities so that (a) the price paid for the experiences is lower, (b) celebrities are more inclined to cooperate, (c) leads are generated for the online and land-based casinos, and (d) the operator of the local jackpot system 100 becomes a main contributor to charity and as such builds upon its positive image. FIG. 6 shows a promotional webpage 400 of the type which may be used to market the concept to casinos or other interested parties.

Although the invention has been described in detail with reference to several embodiments, additional variations and modifications exist within the scope and spirit of the invention.

I claim:

1. A local jackpot system comprising:

a monitoring system in communication with multiple clients in one or more remote locations, said monitoring system comprising one or more processors running or controlled by monitoring system software, said monitoring system configured to:

update jackpot data for a next game round played at casino table games having clients installed thereon;

receive jackpot requests initiated at one or more of said multiple clients, each of said jackpot requests made responsive to outcomes of random generating means running on each of said multiple clients;

responsive to said jackpot requests, reserve a prize for a first player position at said client wherein said random generating means determined a winning outcome;

direct said prize to be awarded to a player at said first player position if said player placed an appropriate bet;

receive one or more additional jackpot requests corresponding to different player positions at said same client if said first player position is not occupied or if said player did not place an appropriate bet until a player position having a player placing an appropriate bet is located; and display a prize notification of at least certain prizes to each of said multiple clients.

2. The local jackpot system of claim 1 further comprising one or more prize tiers.

3. The local jackpot system of claim 2 wherein said prize tiers comprise quick cash prizes, casino-related prizes, bonus prizes, Experiences You Can't Buy prizes and jackpot prizes.

4. The local jackpot system of claim 1 wherein said clients are installed on casino table games having at least a user interface configured to allow a dealer to accept pre-paid bets and activate the local jackpot system.

5. The local jackpot system of claim 1 wherein said clients are configured to notify players of a player position identified to receive a prize which is not paid because a player did not place said appropriate bet; and identify a new player position that did place the appropriate bet.

6. The local jackpot system of claim 1 further comprising an equalizer module for managing prizes with different values within one single prize tier.

7. The local jackpot system of claim 1 wherein said monitoring system is further configured to convert wagers in various currency forms to a single currency form and multiplying both the pool-sizes and such single currency form with the same multiplier to overcome the problem of fractional draws.

8. The local jackpot system of 2 wherein said multiple prize tiers may be uniquely configured on a per client basis in terms of which prizes are offered, hit frequencies, the graphics used and which levels are activated.

9. The local jackpot system of claim 1 further comprising a management module for automatically updating prizes.

10. The local jackpot system of claim 1 wherein said monitoring system is further configured to reserve prizes to have a lock-free environment to be able to accept unlimited amount of bets simultaneous.

11. The local jackpot system of claim 1 wherein said monitoring system is further configured to adapt layouts of local clients to local market needs.

12. The local jackpot system of claim 1 wherein said jackpot data comprises one or more of the following: (i) whether tier 4 and tier 5 prizes are available; (ii) which prizes are available; (iii) a pool size from which a random number is drawn to determine a winning event; (iv) exchange rates and (v) equalizer numbers.

13. A local jackpot system comprising:

a monitoring system in communication with multiple clients in one or more remote locations, said monitoring system comprising one or more processors running or controlled by monitoring system software, said monitoring system configured to:

update jackpot data for a next game round played at casino table games having clients installed thereon;

receive jackpot requests initiated at one or more of said multiple clients, each of said jackpot requests made responsive to matching outcomes of two random number generators running on each of said multiple clients;

responsive to said jackpot requests, reserve a prize for a first player position at said client wherein said random generating means determined a winning outcome;

direct said prize to be awarded to a player at said first player position if said player placed an appropriate bet;

receive one or more additional jackpot requests corresponding to different player positions at said same client if said first player position is not occupied or if said player did not place an appropriate bet until a player position having a player placing an appropriate bet is located; and display a prize notification of at least certain prizes to each of said multiple clients.

14. The local jackpot system of claim 13 further comprising one or more prize tiers.

15. The local jackpot system of claim 14 wherein said prize tiers comprise quick cash prizes, casino-related prizes, bonus prizes, Experiences You Can't Buy prizes and jackpot prizes.

16. The local jackpot system of claim 13 wherein said clients are installed on casino table games having at least a user interface configured to allow a dealer to accept pre-paid bets and activate the local jackpot system.

17. The local jackpot system of claim 13 wherein said clients are configured to notify players of a player position identified to receive a prize which is not paid because a player did not place said appropriate bet; and identify a new player position that did place the appropriate bet.

18. The local jackpot system of claim 13 further comprising an equalizer module for managing prizes with different values within one single prize tier.

19. The local jackpot system of claim 13 wherein said monitoring system is further configured to convert wagers in various currency forms to a single currency form and multiplying both the pool-sizes and such single currency form with the same multiplier to overcome the problem of fractional draws.

20. The local jackpot system of 14 wherein said multiple prize tiers may be uniquely configured on a per client basis in terms of which prizes are offered, hit frequencies, the graphics used and which levels are activated.

21. The local jackpot system of claim 13 further comprising a management module for automatically updating prizes.

22. The local jackpot system of claim 13 wherein said monitoring system is further configured to reserve prizes to have a lock-free environment to be able to accept unlimited amount of bets simultaneous.

23. The local jackpot system of claim 13 wherein said monitoring system is further configured to adapt layouts of local clients to local market needs.

24. The local jackpot system of claim 13 wherein said jackpot data comprises one or more of the following: (i) whether tier 4 and tier 5 prizes are available; (ii) which prizes are available; (iii) a pool size from which a random number is drawn to determine a winning event; (iv) exchange rates and (v) equalizer numbers.

25. A computer-implemented method of operating a local jackpot system comprising:

communicatively linking a monitoring system with a series of clients in one or more remote locations, said monitoring system comprising one or more processors running or controlled by monitoring system software;

updating jackpot data for a next game round played at casino table games having clients installed thereon;

receiving jackpot requests initiated at one or more of said multiple clients, each of said jackpot requests made responsive to outcomes of random generating means running on each of said multiple clients;

responsive to said jackpot requests, reserving a prize for a first player position at said client wherein said random generating means determined a winning outcome;

directing said prize to be awarded to a player at said first player position if said player placed an appropriate bet;

receiving one or more additional jackpot requests corresponding to different player positions at said same client if said first player position is not occupied or if said player did not place an appropriate bet until a player position having a player placing an appropriate bet is located; and displaying a prize notification of at least certain prizes to each of said multiple clients.

26. The method of claim 25 further comprising utilizing one or more prize tiers.

27. The method of claim 26 further comprising utilizing one or more prize tiers comprising quick cash prizes, casino-related prizes, bonus prizes, Experiences You Can't Buy prizes and jackpot prizes.

28. The method of claim 25 further comprising installing said clients on casino table games with at least a user interface configured to allow a dealer to accept pre-paid bets and activate the local jackpot system.

29. The method of claim 25 further comprising configuring said clients to notify players of a player position identified to receive a prize which is not paid because a player did not place said appropriate bet; and identify a new player position that did place the appropriate bet.

30. The method of claim 25 further comprising utilizing an equalizer module for managing prizes with different values within one single prize tier.

31. The method of claim 25 further configuring said monitoring system to convert wagers in various currency forms to a single currency form and multiplying both the pool-sizes and such single currency form with the same multiplier to overcome the problem of fractional draws.

32. The method of 26 further comprising configuring uniquely said multiple prize tiers on a per client basis in terms of which prizes are offered, hit frequencies, the graphics used and which levels are activated.

33. The method of claim 26 further comprising utilizing a management module for automatically updating prizes.

34. The method of claim 25 further configuring said monitoring system to reserve prizes to have a lock-free environment to be able to accept unlimited amount of bets simultaneously.

35. The method of claim 25 further configuring said monitoring system to adapt layouts of local clients to local market needs.

36. The method of claim 25 wherein said jackpot data comprises one or more of the following: (i) whether tier 4 and tier 5 prizes are available; (ii) which prizes are available; (iii) a pool size from which a random number is drawn to determine a winning event; (iv) exchange rates and (v) equalizer numbers.

* * * * *